US005633935A

United States Patent [19]

Kanamori et al.

[11] Patent Number: 5,633,935

[45] Date of Patent: May 27, 1997

[54] STEREO ULTRADIRECTIONAL MICROPHONE APPARATUS

[75] Inventors: Takeo Kanamori, Hirakata; Junichi Tagawa, Osaka; Satoru Ibaraki, Osaka; Hiroki Furukawa, Osaka; Kiminori Ono, Katano, all of Japan

[73] Assignee: Matsushita Electric Industrial Co., Ltd., Japan

[21] Appl. No.: 225,625

[22] Filed: Apr. 11, 1994

[30] Foreign Application Priority Data

Apr. 13, 1993 [JP] Japan ..... 5-085952
Oct. 14, 1993 [JP] Japan ..... 5-256776

[51] Int. Cl.[6] ..... H04R 5/00

[52] U.S. Cl. ..... 381/26; 381/92

[58] Field of Search ..... 381/26, 92, 1, 381/17, 111, 112, 113

[56] References Cited

U.S. PATENT DOCUMENTS

| | | | |
|---|---|---|---|
| 3,715,500 | 2/1973 | Sessler et al. . | |
| 3,793,489 | 2/1974 | Sank . | |
| 4,066,842 | 1/1978 | Allen . | |
| 4,742,548 | 5/1988 | Sessler et al. | 381/92 |
| 4,893,342 | 1/1990 | Cooper et al. | 381/26 |
| 5,107,467 | 4/1992 | Jorgensen et al. | 367/116 |

FOREIGN PATENT DOCUMENTS

| | | |
|---|---|---|
| 2918831 | 11/1980 | Germany . |
| 3-131199 | 6/1991 | Japan . |
| 4-144399 | 5/1992 | Japan . |
| 90 00851 | 1/1990 | WIPO . |

*Primary Examiner*—Curtis Kuntz
*Assistant Examiner*—Vivian Chang
*Attorney, Agent, or Firm*—Rossi & Associates

[57] ABSTRACT

A stereo ultradirectional microphone apparatus for detecting a sound to produce stereo sound signals, comprises: first and second ultradirectional microphones arranged side by side with a given distance in parallel for converting a sound into first and second sound signals respectively, first and second delays for delaying an output of the first and second microphones by a delay time $\tau$ respectively, and first and second subtractors for subtracting for subtraction between the first sound signal and an output of the second delay and subtracting for subtraction between the second sound signal and an output of the first delay. The delay time $\tau$ corresponds to a difference between the timings of a sound from a sound source in a direction making a clockwise angel $\theta$ from the front where a dead angel should be made. The subtraction provides the dead angle. Similarly, a dead angle on the side is also made to obtain a stereo characteristic. The directivity in the frequency characteristic of microphone is equalized to cancel the sensitivity in the dead angle. A stereo apparatus for forming the dead angles with two set of two filters having respective transfer characteristics determined by measurement and an adder is also disclosed.

6 Claims, 11 Drawing Sheets

STEREO ULTRADIRECTIONAL MICROPHONE APPARATUS

BACKGROUND OF THE INVENTION

1. Field of the Invention

This invention relates to a stereo ultradirectional microphone apparatus for receiving and converting a sound into a set of stereo sound signals.

2. Description of the Prior Art

Sets of stereo microphones are known. As a simple, a set of stereo microphones comprising two directional microphones are used. Each of these directional microphones has a unidirectional characteristic showing a high sensitivity in a direction (hereinafter this direction in which the microphone shows a high sensitivity is referred to as a main lobe). Two directional microphones are arranged to obtain a stereo effect such that a lobe of one directional microphone is directed to $+\theta$ direction and a lobe of the other directional microphone is directed to $-\theta$ direction with respect to the front thereof wherein $\theta$ is selected from the range $45° \leqq |\theta| \leqq 90°$. Such general type stereo microphones aim to record sounds from sources existing in a wide angle range viewed from the recording point, i.e., a location of the stereo microphones. However, if a sound from a source existing a predetermined narrow angle range is recorded using general type of stereo microphones, it is impossible to record the sound with a sufficient SN ratio because such stereo microphones have too large width of the main lobe, so that sounds coming from directions other than the predetermined narrow angle rage are recorded as noises. In the actual recording scene, such situations may occur frequently. As a solution to this problem, in place of the unidirectional microphone, an ultradirectional microphone having a more sharp directional characteristics is studied to be applied to the directional microphone apparatus (GERLACH H, "Stereo sound recording with shotgun microphones", J Audio Eng Soc, Vol. 37 No. 10 Page 832–838 '89). This document discloses examples of a stereo recording apparatus to which the ultradirectional microphones is applied, namely, XY and MS structures. The XY structure has two ultradirectional microphones are used where one is directed in $+\theta$ direction and the other is directed in $-\theta$ direction with respect to the front thereof on recording.

The MS structure has one ultradirectional microphone and a hi-directional microphone wherein a main lobe of the ultradirectional microphone is directed to the front and the lobe of the hi-directional microphone is directed to have an angle of 90° from the front. Left side and right side outputs are obtained by adding or subtracting between the outputs of these two microphones. Both XY and MS structures provide the recording of a sound from a source existing in the more narrow angle range than the general stereo microphones. That is, these structures provide the stereo recording of a sound from a more remote sound source because there is a tendency that unnecessary sounds are not mixed with the necessary sound. In other words, assuming the distances between the sound source and the microphones are the same, these structure provide the stereo recording with a higher SN ratio. However, the document reports problems as follows:

In the XY structure, a sound having a high frequency from a sound source existing at left or right side with respect to the microphones is left and the sound existing at the center is suppressed. Contrary, in the MS structure, the higher frequency of a sound, the more the stereo feeling is lost.

SUMMARY OF THE INVENTION

The present invention has been developed in order to remove the above-described drawbacks inherent to the conventional stereo ultradirectional microphone apparatus.

According to the present invention there is provided a first stereo ultradirectional microphone apparatus for detecting a sound to produce stereo sound signals, comprising: a first ultradirectional microphone, having a first unidirectional characteristic, for detecting and converting the sound into a first sound signal, the first unidirectional characteristic showing a first main lobe having a first axis; a second ultradirectional microphone, having a second unidirectional characteristic which is substantially the same as the first ultradirectional microphone, for detecting and converting the sound into a second sound signal, the second unidirectional characteristic showing a second main lobe having a second axis; the first and second ultradirectional microphones being arranged side by side with a predetermined distance therebetween such that the first main lobe is directed in the same direction as the second main lobe and the first axis is in parallel to the second axis substantially; a first delay circuit for delaying the first sound signal by a delay time; a second delay circuit for delaying the second sound signal by the delay time; a first subtracting circuit for effecting subtraction between an output of the second delay circuit and the output of the first sound signal; and a second subtracting circuit for effecting subtraction between an output of the first delay circuit and the second sound signal, the first and second subtracting circuits producing the stereo sound signals. The ultradirectional microphone has a distance factor more than 1.7 or a directivity index less than 0.34. The delay time may be changed. Favorably, a distance factor is more than 2 and a directivity index I is less than 0.25. More favorably, a distance factor is more than 2.2 and a directivity index I is less than 0.20.

According to the present invention there is also provided a second stereo ultradirectional microphone apparatus for detecting a sound to produce stereo sound signals, comprising: a first ultradirectional microphone, having a first unidirectional characteristic, for detecting and converting the sound into a first sound signal, the first unidirectional characteristic showing a first main lobe having a first axis; a second ultradirectional microphone, having a second unidirectional characteristic which is substantially the same as the first ultradirectional microphone, for detecting and converting the sound into a second sound signal, the second unidirectional characteristic showing a second main lobe having a second axis; the first and second ultradirectional microphones being arranged side by side with a predetermined distance therebetween such that the first main lobe is directed in the same direction as the second main lobe and the first axis is in parallel to the second axis substantially; a first equalizing circuit for frequency-equalizing the first sound signal; a second equalizing circuit for frequency-equalizing the second sound signal; a first delay circuit for providing a delay time to an output of the second equalizing circuit against the first sound signal; a second delay circuit for providing the delay time to an output of the first equalizing circuit against the first sound signal; a first subtracting circuit for effecting subtraction between the output of the second equalizing circuit and the first sound signal; and a second subtracting circuit for effecting subtraction between the output of the first equalizing circuit and the second sound signal, the first and second subtracting circuit producing the stereo sound signals. There are various modification in the locations of the delay circuit and the equalizing circuit.

According to the present invention there is further provided a third stereo ultradirectional microphone apparatus for detecting a sound to produce stereo sound signals, comprising: a first ultradirectional microphone, having a first unidirectional characteristic, for detecting and converting the sound into a first sound signal, the first unidirectional characteristic having a first axis; a second ultradirectional microphone, having a second unidirectional characteristic which is substantially the same as the first ultradirectional microphone, for detecting and converting the sound into a second sound signal, the second unidirectional characteristic having a second axis; the first and second ultradirectional microphones being arranged side by side with a predetermined distance therebetween such that the first axis is directed in the same direction D in parallel to the second axis substantially; a first adaptive filter circuit responsive to a first control signal for adaptively frequency-equalizing the first sound signal; a second adaptive filter circuit responsive to a second control signal for adaptively frequency-equalizing the second sound signal; a first delay circuit for providing a delay time to an output of the second adaptive filter circuit against the first sound signal; a second delay circuit for providing the delay time to an output of the first adaptive filter circuit against the first sound signal; a first subtracting circuit for effecting subtraction between the output of the second adaptive filter circuit and the first sound signal; and a second subtracting circuit for effecting subtraction between the output of the first adaptive filter circuit and the second sound signal; a cross-correlation function operation circuit for operating cross-correlation between the first and second sound signals to detects that the cross-correlations in a first direction making a clockwise angle θ from the direction D and in a second direction making a counterclockwise angle θ from the direction D are larger than a predetermined value respectively, the cross-correlation function operation circuit supplying the first and second control signals when the cross-correlation in the first and second directions are larger than the predetermined value respectively.

According to the present invention there is further provided a fourth stereo ultradirectional microphone apparatus for detecting a sound to produce first and second stereo sound signals, comprising: a first ultradirectional microphone, having a first unidirectional characteristic, for detecting and converting the sound into a first sound signal, the first unidirectional characteristic having a first axis; a second ultradirectional microphone, having a second unidirectional characteristic which is substantially the same as the first ultradirectional microphone, for detecting and converting the sound into a second sound signal, the second unidirectional characteristic having a second axis; the first and second ultradirectional microphones being arranged side by side with a predetermined distance therebetween such that the first axis is directed in the same direction D in parallel to the second axis substantially; a first filter, having a first transfer characteristic, for frequency equalizing the first sound signal; a second filter, having a second transfer characteristic, for frequency equalizing the second sound signal; a first summing circuit for summing outputs of the first and second filters to supply the first stereo signal; a third filter, having a third transfer characteristic, for frequency equalizing the first sound signal; a fourth filter, having a fourth transfere characteristic, for frequency equalizing the second sound signal; and a second summing circuit for summing outputs of the third and fourth filters to supply the second stereo signal, the first to fourth transfere characteristics being determined such that a first sensitivity in the first stereo signal in a first direction making a clockwise angle from the first axis is minimized and a second sensitivity in the second stereo signal in a second direction making a counter clockwise angle from the direction D is minimized.

According to the present invention there is further provided a fifth stereo ultradirectional microphone apparatus as described in the fourth stereo ultradirectional microphone apparatus, wherein it is assumed that the first to fourth transfere characteristics are G11(ω), G12(ω), G21(ω), and G22(ω) respectively and the first ultradirectional microphone has first and second sound pressure frequency characteristics in the first and second directions are H11(ω) and H12(ω) respectively, and the second ultradirectional microphone has third and fourth sound pressure frequency characteristics in the first and second directions are H21(ω) and H12(ω) respectively, the G11(ω) to G22(ω) and H11(ω) and H21(ω) are given by:

$$\begin{cases} G_{11}(\omega) = H_{22}(\omega)/(H_{11}(\omega)H_{22}(\omega) - H_{12}(\omega)H_{21}(\omega) \\ G_{12}(\omega) = -H_{12}(\omega)/(H_{11}(\omega)H_{22}(\omega) - H_{12}(\omega)H_{21}(\omega) \\ G_{21}(\omega) = -H_{21}(\omega)/(H_{11}(\omega)H_{22}(\omega) - H_{12}(\omega)H_{21}(\omega) \\ G_{22}(\omega) = H_{11}(\omega)/(H_{11}(\omega)H_{22}(\omega) - H_{12}(\omega)H_{21}(\omega). \end{cases}$$

BRIEF DESCRIPTION OF THE DRAWINGS

The object and features of the present invention will become more readily apparent from the following detailed description taken in conjunction with the accompanying drawings in which.

The same or corresponding elements or parts are designated as like references throughout the drawings.

DETAILED DESCRIPTION OF THE INVENTION

Figure 1:
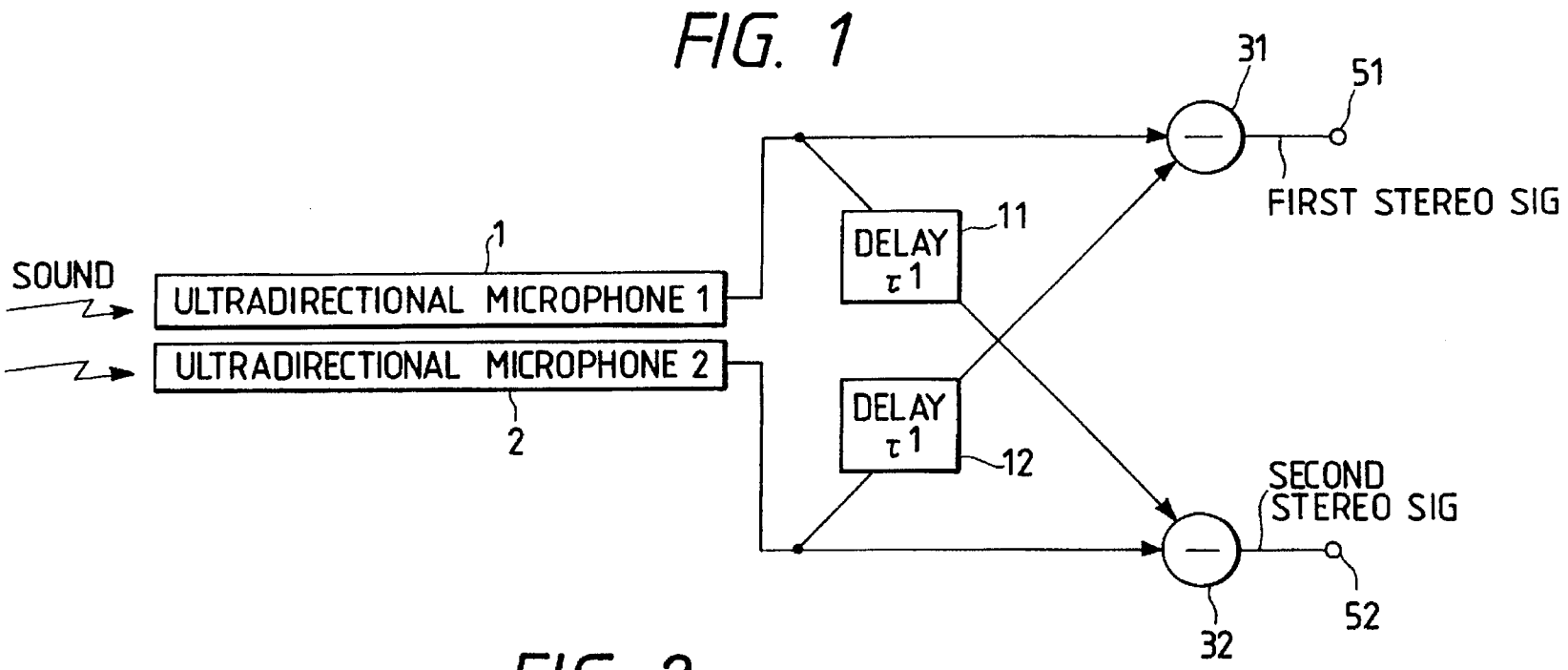
FIG. 1 is a bock diagram of a first embodiment of a stereo ultradirectional microphone apparatus of this invention.

Hereinbelow will be described a first embodiment of this invention with reference to drawings. FIG. 1 is a bock diagram of the first embodiment for showing a structure of a stereo ultradirectional microphone apparatus of this invention. In FIG. 1, numeral 1 is a first ultradirectional microphone, having a main lobe directing in the longitudinal direction thereof, that is, in the front direction thereof, for receiving a sound, and numeral 2 is a second ultradirectional microphone, having the same structure as the first ultradirectional microphone 1, arranged on the left side of the first ultradirectional microphone 1 with respect to the front in parallel to the first ultradirectional microphone 1 to have the same distance from a sound source existing in front thereof. Numeral 11 is a first signal delay circuit for delaying an output signal from the first ultradirectional microphone 1. Numeral 12 is a second signal delay circuit for delaying an output signal from the second ultradirectional microphone 2. Numeral 31 is a first signal subtracting circuit for effecting subtraction between the output signal from the first ultradirectional microphone i and an output signal from the second signal delay circuit 12. Numeral 32 is a second signal subtracting circuit for effecting subtraction between the output signal from the second ultradirectional microphone 2 and an output signal from the first signal delay circuit 11. Numeral 51 is an first output terminal for supplying the output signal from the first subtracting circuit 31. Numeral 52 is a second output terminal for supplying the output signal from the second subtracting circuit 32.

The ultradirectional microphone 1 or 2 has not been strictly defined in the general meaning. However, it is said that the ultradirectional microphone has a sharp directivity such as a secondary sound pressure gradient type microphone or more. In other words, the ultradirctional microphone has directivity more than the hypercardioid directional microphone. As an example of the ultradirectional microphone, there are so-called line microphones or gun microphones. For example, a gun microphone/line microphone MKH 816 manufactured by SENNHEISER, a gun microphone/line microphone MKH 416 manufactured by SENNHEISER, and a gun microphone/line microphone WM-L30 manufactured by MATSUSHITA ELECTRIC INDUSTRIAL CO.,LTD. The gun microphone/line microphone MKH 816 is a typical ultradirectional microphone frequently used in recording studios or broadcasting studios. It has a total length of about 54 cm. The gun microphone/line microphone MKH 416 is shorter than the gun microphone/line microphone MKH 816 and has a width of main lobe sightly larger than the gun microphone/line microphone MKH 816. The gun microphone/line microphone WM-L30 has a directivity corresponding to the gun microphone/line microphone MKH 416. As mentioned above, the ultradirectional microphone has a sharp directivity. However, the ultradirectional microphone is one of the unidirectional microphones. Prabolic microphones are known as the ultradirectional microphone.

In this invention, the ultradirectional microphone has a distance factor F more than 1.7 corresponding to directivity of the cardiode type microphone or directivity index I less than 0.34. Favorably, the ultradirectional microphone has a distance factor F more than 2.0 corresponding to directivity of the hypercardiode type microphone or directivity index I less than 0.25. More favorably, the ultradirectional microphone has a distance factor F more than 2.2 corresponding to directivity of the second order bidirectional type microphone or directivity index I less than 0.20. The gun microphone/line microphone MKH 816 manufactured by SENNHEISER and th gun microphone/line microphone MKH 416 manufactured by SENNHEISER have distance index F of 2.74 and directivity index I of 0.133. Moreover, a cardioid, hypercardiod, second order bidirectional type having a pressure gradient microphoone may be used.

Figure 2:
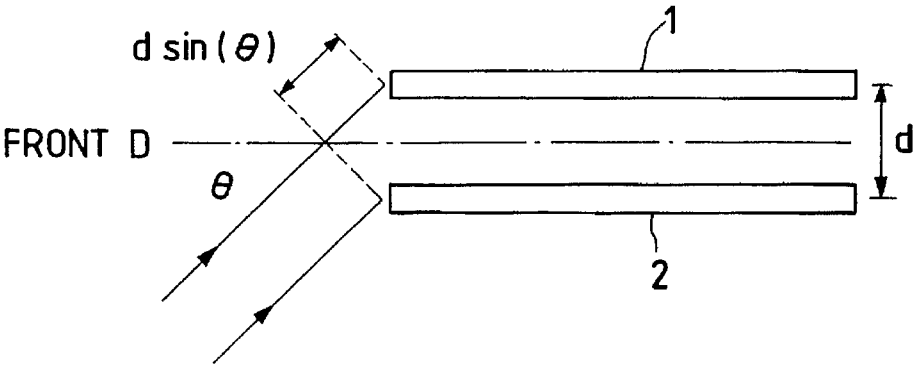
FIG. 2 is a plan view of first to fourth embodiments for showing a relation between the first and second ultradirectional microphones.
Figure 3A:
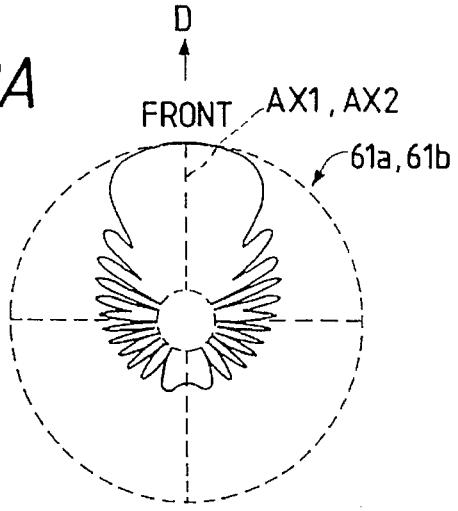
FIGS. 3A to 3E show directional characteristics of output signals of respect portions of the ultradirectional apparatus of the first embodiment.
Figure 3B:
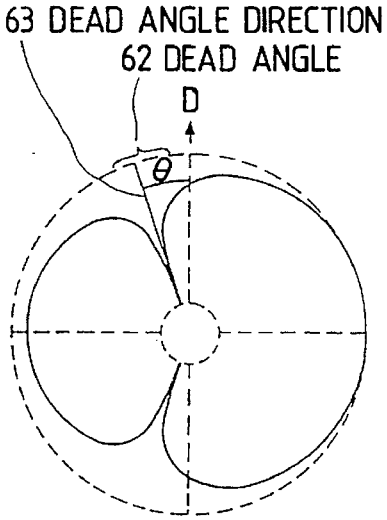
Figure 3C:
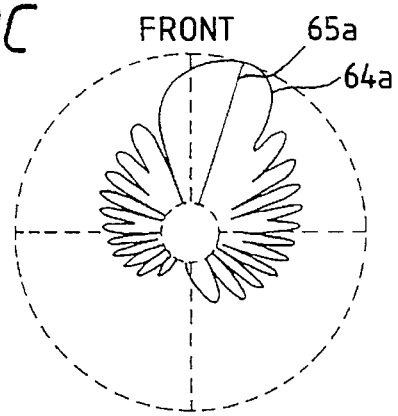
Figure 3D:
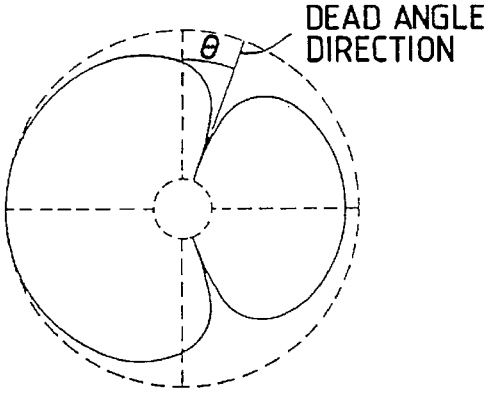
Figure 3E:
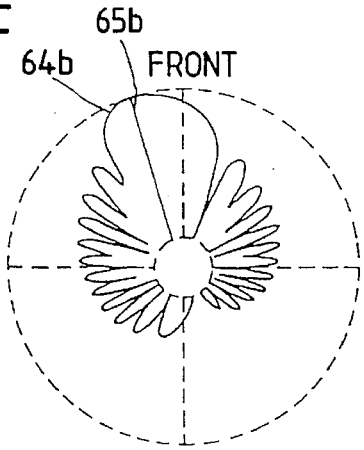

Operation of the stereo ultradirectional microphone apparatus of the first embodiment will be described with reference to FIGS. 1, 2, and 3. FIG. 2 is a plan view for showing a relation between the first and second ultradirectional microphones 1 and 2 and a sound incoming to the first and second ultradirectional microphones 1 and 2, which is common to all embodiments of this invention. FIGS. 3A to 3D show directional characteristics of output signals of respect portions of the ultradirectional apparatus of the first embodiment. In FIG. 1, it is assumed that the first ultradirectional microphone 1 has substantially the same directional characteristic (shown in FIG. 3A) as the second ultradirectional microphone 2. The directional characteristics of the first and second ultradirectional microphones 1 and 2 shown in FIG. 3A show main lobes 61*a* and 61*b* directed in the front direction D with axes AX1 and AX2 respectively. The first and second ultradirectional microphones 1 and 2 are arranged side by side with a distance d therebetween such that the main lobe 61*a* of the first ultradirectional microphone 1 is directed in the same direction as the main lobe 61*b* of the second ultradirectional microphone 2 and the axis AX1 of the main lobe 61*a* is in parallel to the axis AX2 substantially. A sound from a sound source located in the front of the ultradirectional microphones 1 and 2 enters the ultradirectional microphones 1 and 2. The ultradirectional microphones 1 and 2 convert the sound into electric sound signals respectively. The first signal subtracting circuit 31 operates subtraction between the output signal of the first ultradirectional microphone 1 and a signal obtained by delaying the output signal of the second ultradirectional microphone 2 by τ 1 by the signal delay circuit 12. As the result, an output signal from the first signal subtracting circuit 31 includes a directional characteristic as shown in FIG. 3B wherein a dead angle 62 is formed in a dead angle direction 63 making a counterclockwise angle θ° from the front direction D of the ultradirectional microphones 1 and 2 in addition to the directional characteristic as shown by FIG. 3A. The angle θ is given:

$$\theta = \sin^{-1}\left(\frac{\tau 1 \cdot c}{d}\right) \tag{1}$$

where a distance between the first and second ultradirectional microphones 1 and 2 is d and the sound speed is c. More specifically, the distance d is a distance between the acoustic holes 1*a* and 1*b* (mentioned later) of the first and second ultradirectional microphones 1 and 2. The relation among θ, d, τ 1, and c is shown in FIG. 2. A sound incoming in a direction making a counterclockwise angle θ from the front of the ultradirectional microphones 1 and 2 reaches the second ultradirectional microphone 2 first and then, reaches the first ultradirectional microphone 1 with a delay time d·sin(θ)/c. Therefore, a sensitivity in the direction making the counterclockwise angle θ from the front of the ultradirectional microphones 1 and 2 can be reduced to nearly zero by delaying the output signal from the second ultradirectional microphone by $\tau 1=d\cdot\sin(\theta)/c$ with the signal delay circuit 12 and by subtracting the delayed signal from the output signal from the first ultradirectional microphone 1. In other words, a dead angle is formed in the direction making the counterclockwise angle θ from the front of the ultradirectional microphones 1 and 2. This corresponds to the method of forming directional characteristic in the pressure-gradient microphones and the directional characteristic added by this operation is shown by FIG. 3B. That is, the final directional characteristic of the output signal of the signal subtracting circuit 31 is obtained such that the directional characteristic shown in FIG. 3A is multiplied with that shown in FIG. 3B, that is, it is shown as FIG. 3C. Similarly, the final directional characteristic of the output signal of the signal subtracting circuit 32 is obtained such that the directional characteristic shown in FIG. 3A is multiplied with that shown in FIG. 3D, that is, it is shown as FIG. 3E. Therefore, the combined directional characteristics as shown in FIG. 3C and 3E provide stereo recording of a sound from a remote sound source. That is, the output of the first and second subtracting circuits 31 and 32, i.e., first and second stereo sound signals having first and second directional characteristics showing third and fourth main lobes 64*a* and 64*b* having third and fourth axes 65*a* and 65*b* respectively and the delay time is determined by the predetermined distance d and a half of the angle between the third and fourth axes 65*a* and 65*b*.

Figure 4A:
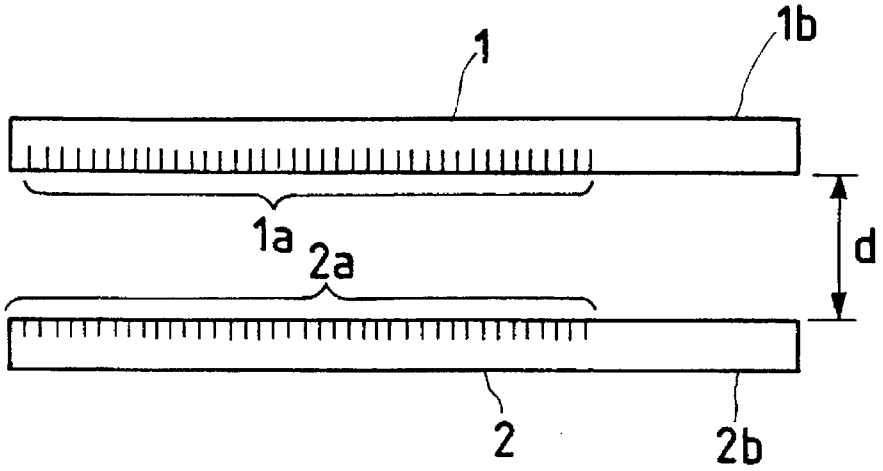
FIG. 4A is a plan view of the first embodiment for showing an example of arrangement of the ultradirectional microphones.
Figure 4B:
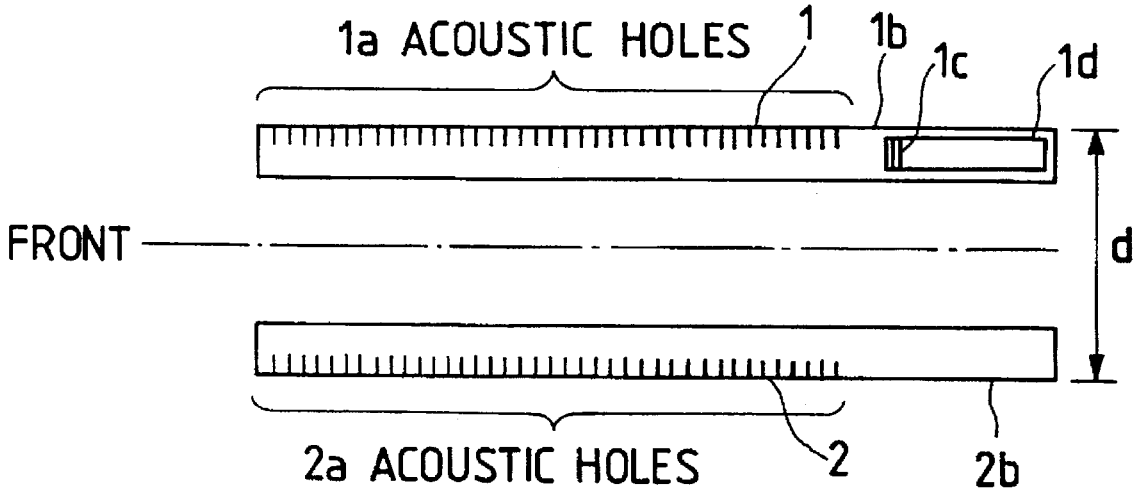
FIG. 4B is a plan view of the first modification of the first embodiment.

A first modification of the first embodiment will be described. FIG. 4A is a plan view of the first embodiment for showing an example of arrangement of the ultradirectional microphones 1 and 2. FIG. 4B is a plan view of the first modification of the first embodiment.

In the first embodiment, each of the ultradirectional microphones 1 and 2 has an acoustic tube 1*b* where acoustic holes 1*b* are arranged on a side surface of the acoustic tube 1*b* in the longitudinal direction of the acoustic tube 1*b*. The acoustic holes 1*a* respectively allow the sound to enter the acoustic tube 1*b* to obtain the ultradirectional characteristic. A microphone unit 1*d* having a diaphragm 1*c* for receiving the sound is provided to one end of the acoustic tube 1*b*. The sound which entered the acoustic tube 1*b* is guided by the acoustic tube 1*b* and is received by the diaphragm 1*c* of the microphone unit 1*d*, i.e., a condenser microphone unit. Moreover, the ultradirectional microphones 1 and 2 are arranged such that acoustic holes 1*a* of the ultradirectional microphone 1 confront to acoustic holes 2*a* of the ultradirectional microphone 2 as shown in FIG. 4A. On the other hand, as shown in FIG. 4B in the modification of the first embodiment, the ultradirectional microphones 1 and 2 are arranged such that the acoustic holes 1*a* are directed in the opposite direction of acoustic holes 2*a* of the ultradirectional microphone 2. This arrangement is provided in order to maintain the distance d relatively larger to improve a directional characteristic at low frequencies with a compact size of the stereo ultradirectional microphone apparatus. That is, as shown in FIG. 4B, the size of this stereo ultradirectional microphone apparatus can be miniaturized by that the first and second ultradirectional microphones 1 and 2 are arranged as close as possible.

Figure 4C:
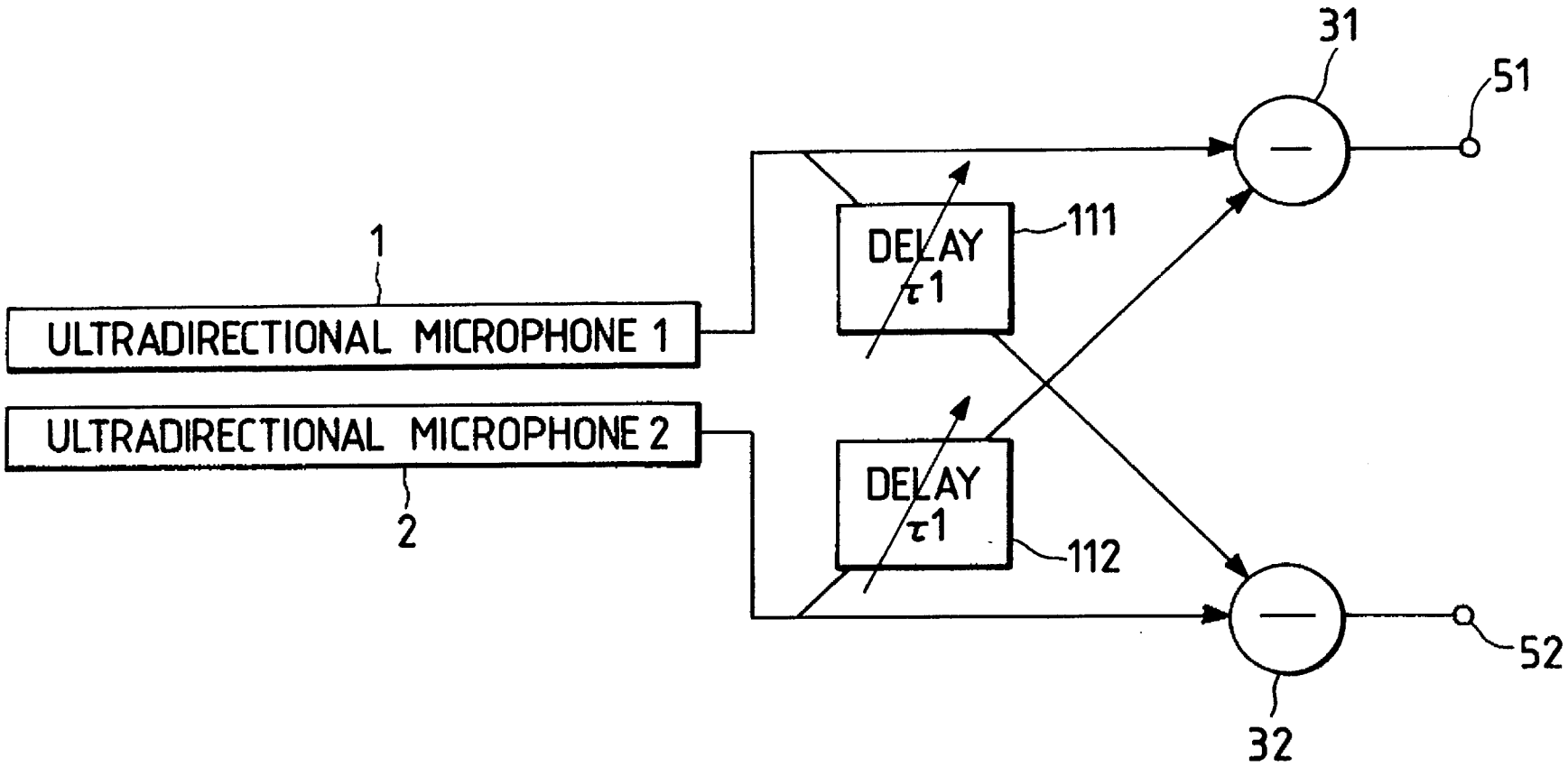
FIG. 4C is a block diagram of a second modification of the first embodiment.
Figure 4D:
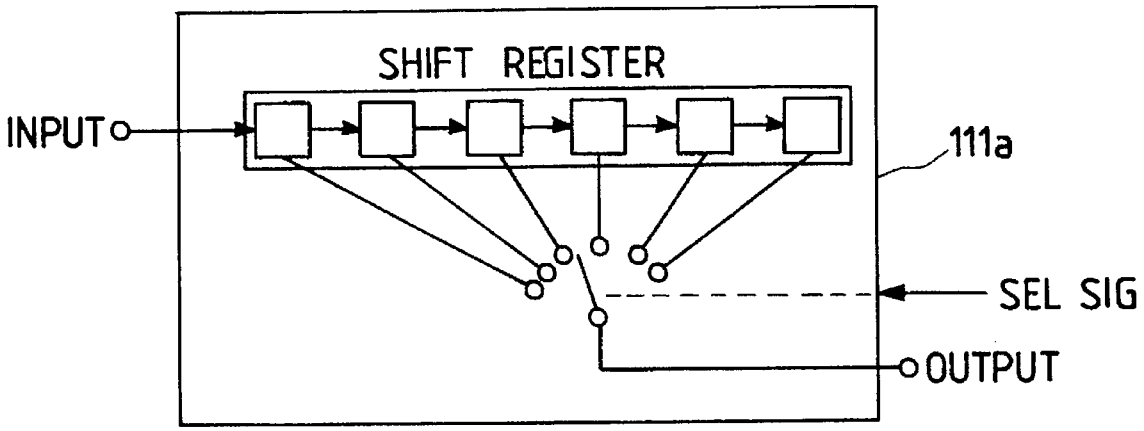
FIG. 4D is a block diagram of an example of the signal delay circuit of the second modification of the first embodiment.
Figure 4E:
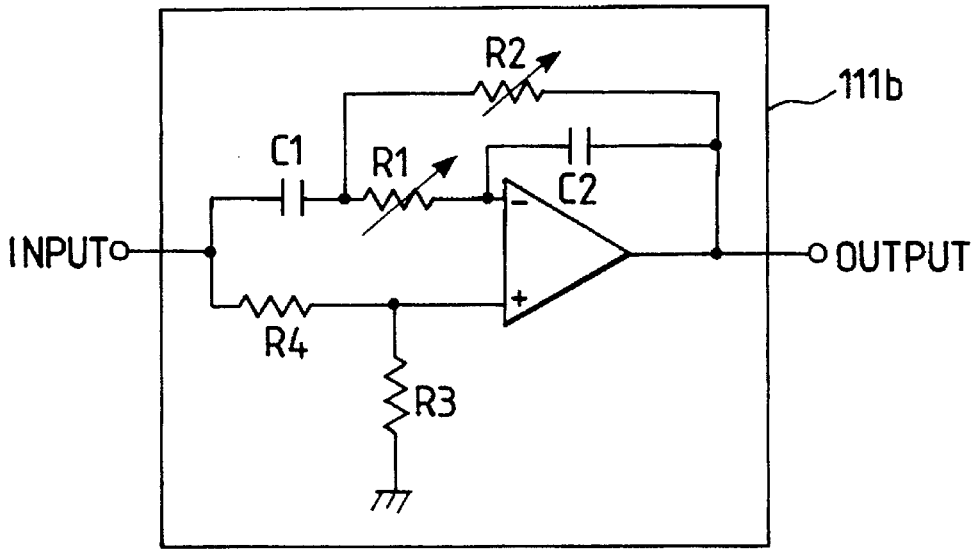
FIG. 4E is a block diagram of another example of the signal delay circuit of the second modification of the first embodiment.

FIG. 4C is a block diagram of a second modification of the first embodiment. The basic structure of the second modification of the first embodiment is substantially the same as the first embodiment. The difference between the second modification and the first embodiment is in that delay times of the signal delay circuits 111 and 112 are variable. The variation in the delay time of the signal delay circuit 111 and 112 provides the change of an angle between the main lobes 64*a* and 64*b* of combined directional characteristics of the first and second stereo signals, that is, the directional characteristics of the output of the signal subtracting circuits 31 and 32. In other words, the variation in the delay time of the signal delay circuit 111 and 112 provides the change of an angle between the dead angle 62 formed in the directional characteristics of the outputs of the signal subtracting circuits 31 and FIG. 4D is a block diagram of an example of the signal delay circuit of the second modification of the first embodiment. This example shows a digital type of the signal delay circuit. That is, the signal delay circuit 111*a* comprises a shift register circuit having a plurality of shift register elements and a switch circuit for selectively output of either of the shift register element in response to a selection signal externally inputted. This switch may be operated manually using a manually operation switch. The number of stages of the shift registers is determined by the switch circuit and the delay time is determined by this number. FIG. 4E is a block diagram of another example of the signal delay circuit of the second modification of the first embodiment. This example shows an analog type of the signal delay circuit 111*b*. The signal delay circuit 111*b* comprises an operational amplifier circuit forming a secondary phase shifter having variable resistors R1 and R2. The resistances of the R1 and R2 are changed to vary the delay time under the condition that a multiplication between resistances of R1 and R2 is constant.

As described above, the second modification of the first embodiment, change in the delay times τ 1 of the first and second signal delay circuits provides a change the direction of the dead angle 62 represented by angle θ. In this condition, $0<\tau 1\leqq d/c$ when $0°<\theta\leqq 90°$.

Figure 5A:
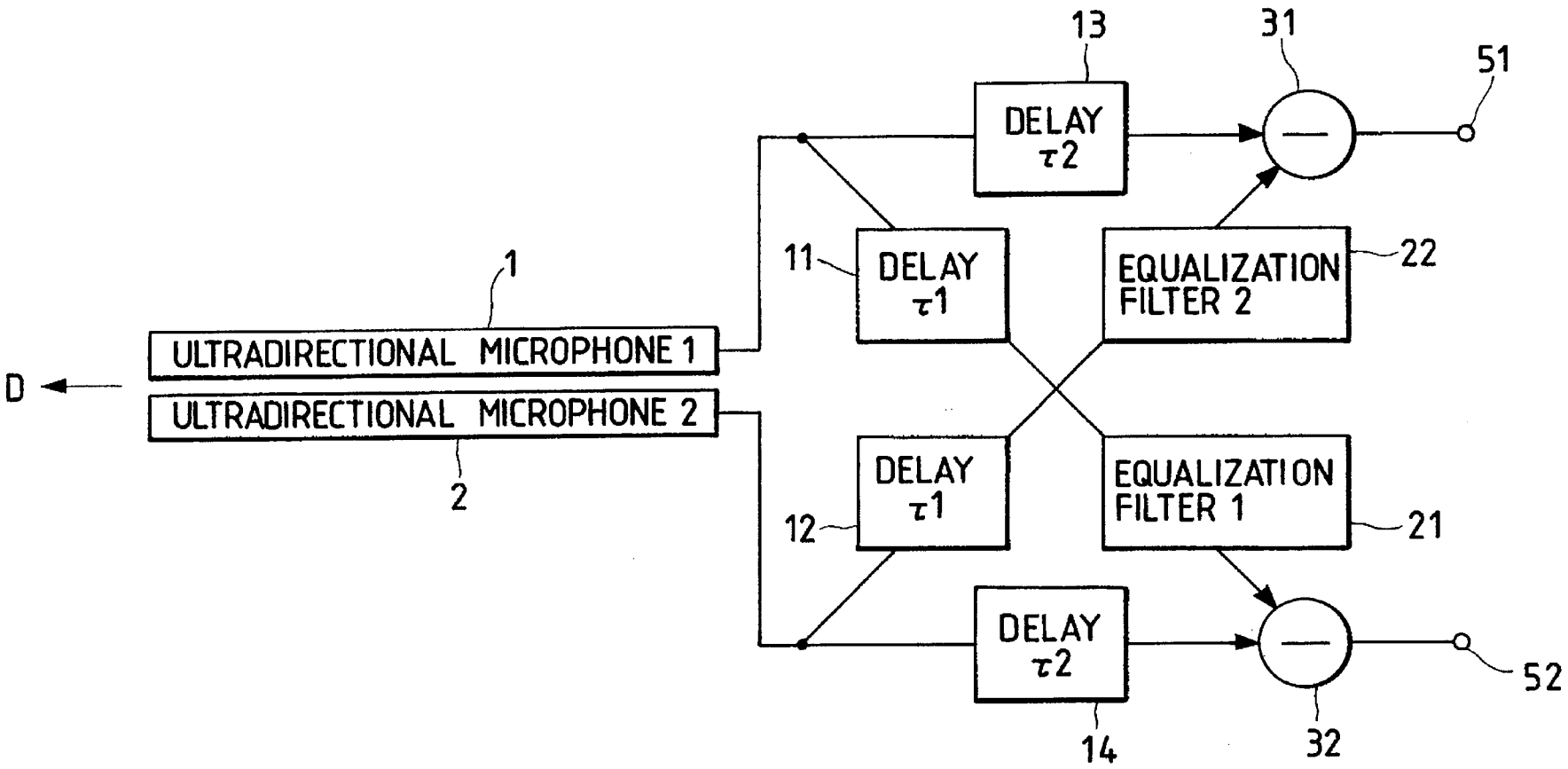
FIG. 5A is a block diagram of a second embodiment showing a structure of the stereo ultradirectional microphone apparatus of the second embodiment.

Hereinbelow will be described a second embodiment of a stereo ultradirectional microphone apparatus of this invention with reference to drawings. FIG. 5A is a block diagram of the second embodiment showing a structure of the stereo ultradirectional microphone apparatus. In FIG. 5A, numeral 1 is a first ultradirectional microphone, and numeral 2 is a second ultradirectional microphone arranged on the left side of the first ultradirectional microphone 1 with respect to the front thereof in parallel to the first ultradirectional microphone 1 to have the same distance from a sound source existing in Front thereof. Numeral 11 is a first signal delay circuit for delaying an output signal from the first ultradirectional microphone 1. Numeral 12 is a second signal delay circuit for delaying an output signal from the second ultradirectional microphone 1. Numeral 13 is a third signal delay circuit for delaying an output signal from the first ultradirectional microphone 1. Numeral 14 is a fourth signal delay circuit for delaying an output signal from the second ultradirectional microphone 1. Numeral 21 is a first equalization Filter for frequency-equalizing an output signal from the first signal delay circuit 11. Numeral 22 is a second equalization Filter for frequency-equalizing an output signal from the second signal delay circuit 12. Numeral 31 is a first signal subtracting circuit for effecting subtraction between the output signal of the second equalization filter 22 and an output signal from the third signal delay circuit Numeral 32 is a second signal subtracting circuit for effecting subtraction between the output signal of the first equalization filter 21 and an output signal from the fourth signal delay circuit 14. Numeral 51 is an first output terminal for supplying the output signal from the subtracting circuit 31. Numeral 52 is a second output terminal for supplying the output signal from the subtracting circuit 31.

Operation of the stereo ultradirectional microphone apparatus structured as mentioned above will be described. In FIG. 5A, the difference between this embodiment and the first embodiment is in that the third signal delay circuit 13 is provided between the first ultradirectional microphone 1 and the first signal subtracting circuit 31, the fourth signal delay circuit 14 is provided between the second ultradirectional microphone 2 and the second signal subtracting circuit 32, the first equalization filter 21 is provided between the first signal delay circuit 11 and the second signal subtracting circuit 32, and the second equalization filter 22 is provided between the second signal delay circuit 12 and the first signal subtracting circuit 31. These added equalization filters 11 and 22 are provided for equalizing in the amplitude phase characteristics between the first and second ultradirectional microphones 1 and 2. That is, generally, there is a dispersion between the ultradirectional microphones 1 and 2 in the amplitude phase characteristic. Therefore, these additional circuits are provided to accurately equalize the amplitude phase characteristic of the first and second ultradirectional microphones 1 and 2 and cancel the resultant sound signals obtained by the first and second signal subtracting circuit 31 and 32 respectively when the sounds are incoming from sound sources existing in the dead angles. In connection with determination of transfer characteristics of the first and second equalization filters 21 and 22, assuming that sound pressure frequency characteristics of the first and second ultradirectional microphones 1 and 2 with respect to the direction providing a clockwise angle θ° are $M1_R(\omega)$ and $M2_R(\omega)$ respectively, the transfer characteristic $H1(\omega)$ of the first equalization filter 21 is determined by:

$$H1(\omega)=\frac{M2_R(\omega)}{M1_R(\omega)} \tag{2}$$

The output of the first ultradirectional microphone 1 with respect to the sound incoming from a direction providing the clockwise angle θ is delayed by a delay time τ 1 by the first signal delay circuit 11 and then the delayed signal is multiplied by the characteristic represented by Eq. (2) by the first equalization filter 21 to equalizes the delayed signal to have the sound pressure characteristic of the second ultradirectional microphone 2 with respect to the direction providing the clockwise angle θ°. The equalized signal is subtracted from the output of the fourth signal delay circuit 14 by the second signal subtracting circuit 32 to cancel the sound signal of the sound incoming from the direction providing the clockwise angle θ°. Here, the fourth signal delay circuit 14 is provided to effect a compensation for the signal delay in the first equalization filter 21. Similarly, the transfere characteristic $H2(\omega)$ of the first equalization filter 22 is determined by:

$$H2(\omega)=\frac{M1_L(\omega)}{M2_L(\omega)} \tag{3}$$

where $M1_L(\omega)$ and $M2_L(\omega)$ are sound pressure frequency characteristics of the first and second ultradirectional microphones 1 and 2 with respect to the direction providing a counterclockwise angle θ° from the front direction D.

The output of the second ultradirectional microphone 2 with respect to the sound incoming from a direction providing the counterclockwise angle θ° is delayed by a delay time τ 1 by the second signal delay circuit 12 and then, the delayed signal is multiplied by the characteristic represented by Eq. (3) by the second equalization filter 22 to equalize the delayed signal to have the sound pressure characteristic of the first ultradirectional microphone 2 with respect to the direction providing the counterclockwise angle θ°. The equalized signal is subtracted from the output of the third signal delay circuit 13 by the first signal subtracting circuit 31 to cancel the sound signal of the sound incoming from the direction providing the counterclockwise angle θ°. Here, the third signal delay circuit 13 is provided to effect a compensation for the signal delay in the second equalization filter 22.

As mentioned above, in the second embodiment, if there is a dispersion in the frequency characteristic or the like, between the first and second ultradirectional microphones 1 and 2, the dead angles in the directions providing clockwise and counterclockwise angle from the front of the first and second ultradirectional microphones 1 and 2 are accurately formed. Therefore, favourable directivities of stereo ultradirectional microphone apparatus are provided.

Figure 5B:
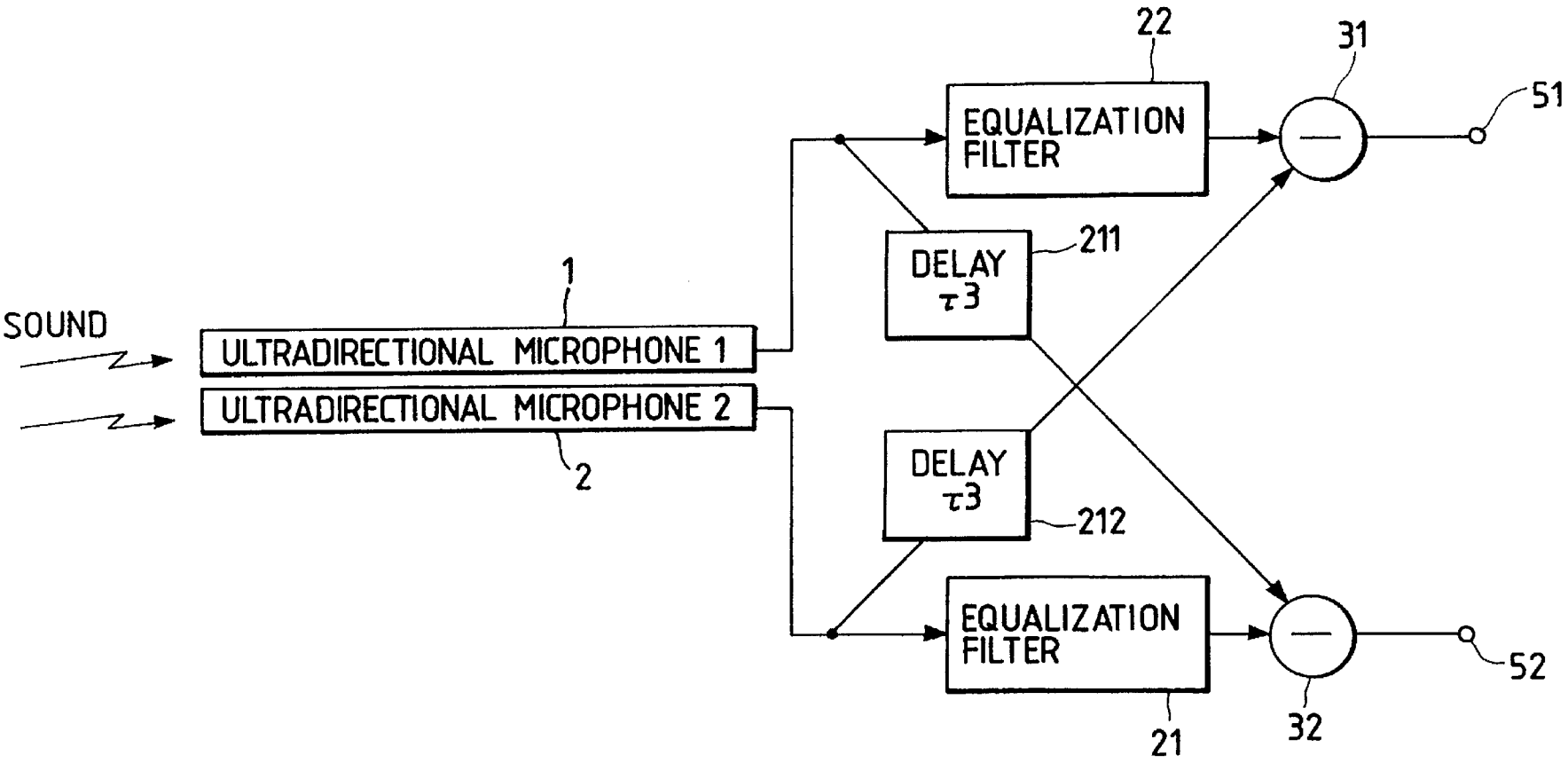
FIG. 5B is a block diagram of a modification of the second embodiment.

In this embodiment, the difference between the delay of the delay 13 and the total delay time of the signal delay circuit 12 and the equalization filter 22 corresponds to d·sine (θ). Therefore, the signal delay circuit 11 and 12 can be omitted case by case. For example, if the equalization filter 22 has a delay time of d·sine(θ), the FIG. 5B is a block diagram of a first modification of the second embodiment. The basic structure of this first modification is substantially the same as the second embodiment. The difference between this modification of the second embodiment and the second embodiment is in that the equalization filter 21 is provided between a junction point between the ultradirectional microphone 2 and the delay circuit 212 and the subtracting circuit 32. Moreover, the equalization filter 22 is provided between a junction point between the ultradirectional microphone 1 the delay circuit 211 and the subtracting circuit 31. Further, the delay circuits 13 and 14 are omitted and delay circuits 211 and 212 has a delay time τ 3.

An output of the first ultradirectional microphone 1 is delayed by the delay circuit 211. An output of the second ultradirectional microphone 1 is frequency-equalized by the equalization filter 21. The subtracting circuit 32 subtracts the output of the delay circuit 211 from the output of the equalization filter 21. Similarly, the output of the second ultradirectional microphone 2 is delayed by the delay circuit 212. The output of the first ultradirectional microphone 1 is frequency-equalized by the equalization filter 22. The subtracting circuit 31 subtracts the output of the delay circuit 212 from the output of the equalization filter 22. The outputs of the subtracting circuits 31 and 32 provide stereo signals. The delay time τ 3 corresponds to a total of the delay time τ 1 and the delay time of the equalization filter 21 or 22.

As mentioned above, only one modification of the second embodiments is described. However, there are many modifications of the second embodiment can be considered with respect to locations of the equalizing filters and delay circuits.

Figure 6:
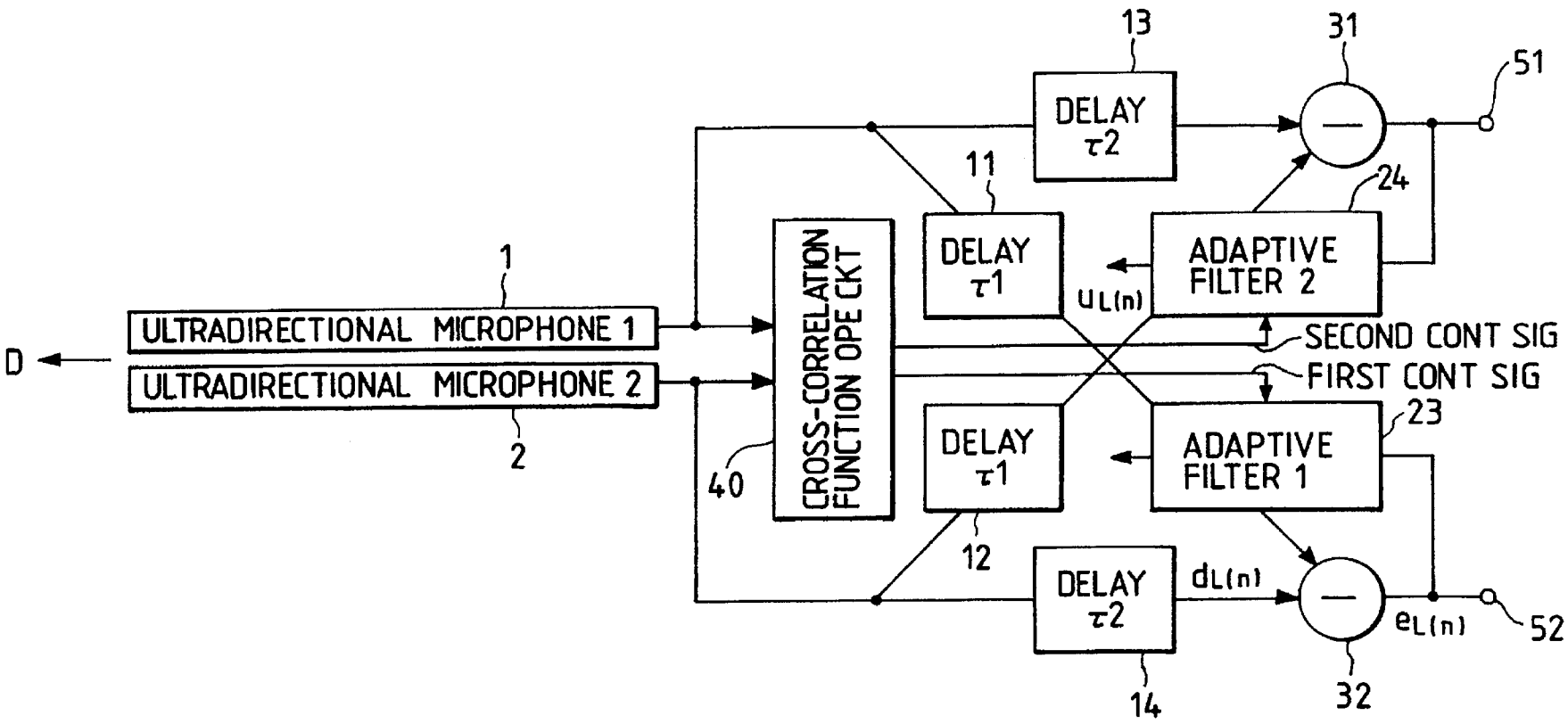
FIG. 6 is a block diagram of a third embodiment of the stereo ultradirectional microphone apparatus.

Hereinbelow will be described a third embodiment of a stereo ultradirectional microphone apparatus of this invention with reference to drawings. FIG. 6 is a block diagram of the third embodiment showing a structure of the stereo ultradirectional microphone apparatus of the third embodiment. In FIG. 6, the first ultradirectional microphone 1, the second ultradirectional microphone 2, the first signal delay circuit 11, the second signal delay circuit 12, the third signal delay circuit 13, the fourth signal delay circuit 14, the first and second signal subtracting circuit 31 and 32, and the first and second output terminals 51 and 52 have the same structure as the second embodiment respectively. The difference between the second and third embodiment in the structure is as follows: Numeral 40 is a cross-correlation function operation circuit for operating cross-correlation function in response to the output signals of the first and second ultradirectional microphones 1 and 2. Numeral 23 is a first adaptive filter 23 which is replaced with the equalization filter 21 of the second embodiment. The first adaptive filter 23 effects the frequency equalizing of the output signal of the first signal delay circuit 11 with a transfer characteristic adaptively renewed on the basis of the output of the second signal subtracting circuit 32 in response to a first control signal, i.e., an output of the cross-correlation function operation circuit 40 to supply its output to the second signal subtracting circuit 32. Numeral 24 is a second adaptive filter which is replaced with the equalization filter 22 of the second embodiment. The second adaptive filter 24 effects the frequency equalizing of the output signal of the second signal delay circuit 12 with a transfer characteristic adaptively renewed on the basis of the output of the first signal subtracting circuit 31 in response to a second control signal, i.e., an output of the cross-correlation function operation circuit 40 to supply its output to the first signal subtracting circuit 31. In FIG. 6, leftward arrows (in this drawing) attached to blocks 23 and 24 denote that these blocks are the adaptive filters.

Operation of the stereo microphone of the third embodiment will be described with reference to FIG. 6. In FIG. 6, the difference in operation between the third embodiment and the second embodiment is in that the first and second adaptive filters 23 and 24 adaptively equalize the dispersion in frequency characteristic with respect to the sound incoming in the dead angle directions (±θ°) between the first and second ultradirectional microphones 1 and 2. Here, as an example of the first and second adaptive filters 23 and 24, an adaptive equalizer will be described which employs the normalized LMS algorithm (which is disclosed, for example, in J. I. Nagumo and A. Noda, "A Learning Method for System Identification", IEEE Trans. Automatic Control, vol. AC-12, pp. 282–287, Jun. 1967, or A. E. Albert and L. S. Gardner, Jr., "Stochastic Approximation and Nonlinear Regression", (MIT Press, 1967)).

Assuming that an impulse response (filter coefficient) providing a transfer characteristic of the first adaptive filter 23 is $h_L(n)$, the output of the first signal delay circuit 11 is $u_L(n)$, the output of the fourth signal delay circuit 14 is $d_L(n)$, and the output of the second signal subtracting circuit 32 is $e_L(n)$, the normalized LMS algorithm is represented by Eqs. (4) and (5).

$$h_L(n+1) = h_L(n) + \frac{\alpha}{\|u_L(n)\|^2} u_L(n) e_L(n) \tag{4}$$

$$e_L(n) = d_L(n) - u_L^T(n) h_L(n) \tag{5}$$

The first adaptive filter 23 renews the filter coefficients represented by Eq. (4) and effects an operation of the second term on the right side of Eq. (5). The sine of "–" on the right side of Eq. (5) corresponds to the operation of the second signal subtracting circuit 32. If $u_L(n)$ and $d_L(n)$ are independent each other, the Eq. (4) cannot converge. Therefore, in order to operate the adaptive filter normal, it is necessary to renew the filter coefficient represented by Eq. (4) only when a sound incoming from the dead angle direction has larger intensity. Accordingly, the cross-correlation function operation circuit 40 detects whether or not correlation with respect to a sound incoming in the direction providing the clockwise angle θ° from the front of the ultradirectional microphones 1 and 2 is high to supply the correlation detection signal as the first control signal to the first adaptive filter 23. In response to this, the first adaptive filter 23 renews the filter coefficient represented by Eq. (4) only when the correlation is high. The fourth signal delay circuit 14 is provided for satisfying the law of cause and effect with respect to time base of respective signals, that is, it delays the output of the ultradirectional microphone 2 with a time delay τ 2 corresponding to a time interval of the filter impulse response $h_L(n)$. According to the structure mentioned above, the filter coefficients $h_L(n)$ is renewed such that $e_L(n)$ becomes close to zero with respect to the sound incoming from the direction providing the clockwise angle θ° from the front of the ultradirectional microphones 1 and 2. Therefore, a dead angle in the directivity in the direction providing the clockwise angle θ° from the front of the ultradirectional microphones 1 and 2 is clearly formed.

Assuming that an impulse response (filter coefficient) providing a transfer characteristic of the second adaptive filter 24 is $h_R(n)$, the output of the second signal delay circuit 12 is $u_R(n)$, the output of the third signal delay circuit 13 is $d_R(n)$, and the output of the first signal subtracting circuit 31 is $e_R(n)$, the normalized LMS algorithm is represented by Eqs. (6) and (7).

$$h_R(n+1) = h_R(n) + \frac{\alpha}{\|u_R(n)\|^2} u_R(n) e_R(n) \tag{6}$$

$$e_R(n) = d_R(n) - u_R^T(n) h_R(n) \tag{7}$$

The second adaptive filter 24 renews the filter coefficients represented by Eq. (6) and effects an operation of the second term on the right side of Eq. (7). The sine of "-" on the right side of Eq. (7) corresponds to the operation of the first signal subtracting circuit 31. If $d_R(n)$ and $u_R(n)$ are independent each other, the Eq. (6) cannot converge. Therefore, in order to operated the adaptive filter normal, it is necessary to renew the filter coefficient represented by Eq. (6) only when a sound incoming from the dead angle direction has larger intensity. Accordingly, the cross-correlation function operation circuit 40 detects whether or not correlation with respect to a sound incoming in a direction providing the counterclockwise angle θ° from the front of the ultradirectional microphones 1 and 2 is high to supply the correlation detection signal to the second adaptive filter 24. The second adaptive filter 24 renews the filter coefficient represented by Eq. (6) only when the correlation is high. The third signal delay circuit 13 is provided for that the output of the ultradirectional microphone 1 is delayed in accordance with the delay time occurring in the adaptive filter 24. That is, the delay time is se to τ 2 corresponding to the filter impulse response $h_R(n)$. According to the structure mentioned above, the filter coefficients $h_R(n)$ is renewed such that $e_R(n)$ becomes close to zero with respect to the sound incoming from the direction providing counterclockwise angle θ° from the front of the ultradirectional microphones 1 and 2. Therefore, a dead angle in the directivity in the direction providing the counterclockwise angle θ° from the front of the ultradirectional microphones 1 and 2 is clearly formed.

Here, $h_L(n)$ and $h_R(n)$ are vectors representing filter coefficient array at a time n and $u_L(n)$ and $u_L(n)$ are tap input vectors ($u_L(n)=\{u_L(n), u_L(n-1,) u_L(n-2), \ldots\}$, and the dimension of respective vector are equal.

As similar to the second embodiment, there are many modifications can be considered with respect to the locations of the delay circuits and the adaptive filters as clearly understood from FIG. 5B.

Here, the operation of the third embodiment will be described more specifically. In order to form the dead angles mentioned above, it is necessary to effect equalization in the sound pressure frequency characteristic between the ultradirectional microphones i and 2 before the subtraction for forming the dead angle. Generally, there is a slight dispersion in the characteristic between the ultradirectional microphones 1 and 2 due to the manufacturing process. When the signals from the two microphones are cancelled by subtraction, the agreement between these two microphones in the pressure frequency characteristic with respect to directions of the dead angles is necessary. Therefore, the adaptive filters 23 and 24 are provided to effect equalization in the sound pressure sensitivity characteristic characteristic between the ultradirectional microphones 1 and 2. The adaptive filter 23 has a given filter coefficient $h_L$ in the initial condition. That is, the adaptive filter 23 does not have a filter characteristic for effecting equalization between the ultradirectional microphones 1 and 2 in the initial condition. The adaptive filter 23 renews the filter coefficient in accordance with the result of the Eqs. (4) and (5) obtained on the basis of the error signal $e_L$, i.e., the output of the signal subtracting circuit 32 in response to the first control signal, that is, the output signal of the cross-correlation function operation circuit 40. This converges the error signal $e_L$ such that the error signal has a minimum value. The smaller the error signal $e_L$ the smaller the output of the second signal subtracting circuit 32. In other words, the apparent sensitivity of the ultradirectional microphone 2 in the dead angle decreases in the necessary frequency range. Therefore, the adaptive filter 23 operates as the frequency equalizer by renewing of the filter coefficient, so that signal cancelling is effected accurately.

Here, it is necessary to renew the filter coefficient only when the sound incoming from the desired dead angle direction. In other words, if the renewing is effected when the sound comes from only the front, the dead angle would be formed in the front of the ultradirectional microphones 1 and 2. This is different from the desired directivity. Therefore, the desired directivity having dead angles in the directions making the clockwise and counter clockwise angles of θ° should be formed. Thus, when the sound comes in the direction of the desired dead angle, the cross-correlation function operation circuit 40 output the first or second control signal. The cross-correlation function operation circuit 40 detects this. That is, in connection with the dead angle making the clockwise angle, the cross-correlation function operation circuit 40 detects whether signal components in the output of the ultradirectional microphones 1 and 2 incoming from the dead angle in the direction making the clockwise angle of θ° from the front have a larger intensity than signal components incoming from the other directions. More specifically, the cross-correlation function operation circuit 40 detects a cross-correlation function $R_{XY}(1)$ from the outputs of the ultradirectional microphones 1 and 2 and detects a degree of the correlation of the sound signal components incoming from the dead angle in the direction making the clockwise angle of θ°. The cross-correlation function $R_{XY}$ is given by:

$$R_{XY}(1)=E\{X(t+1)Y(t)\}$$

where E{} is an expected value.

It is assumed that the output of the ultradirectional microphone 1 is X(t) and the output of ultradirectional microphone 1 is Y(t). The term Y(t) lags the term X(t) with respect to the sound signal incoming in the direction making the clockwise angle θ° has a delay d·sine(θ). Therefore, if $R_{XY}(d\cdot\sin(\theta))>a$, the cross-correlation function operation circuit 40 outputs the first control signal to effect renewing the filter coefficient of the adaptive filter 23 because the correlation of the sound signal incoming from the desired dead angle in the direction making the clockwise angle θ is large. If $R_{XY}(-d\cdot\sin(\theta))>a$, the cross-correlation function operation circuit 40 outputs the second control signal to effect renewing the filter coefficient of the adaptive filter 24 because the correlation of the sound signal incoming from the desired dead angle in the direction making a counter-clockwise angle θ is large. Here d is the distance between the ultradirectional microphones 1 and 2 and a is a predetermined threshold value.

The cross-correlation function operation circuit 40 detects the cross-correlation function with respect to the right and left dead angles at regular time interval and the cross-correlation of the right and left dead angles are large, the first and the second control signals are supplied to the first and second adaptive filter 23 and 24 respectively.

Figure 7:
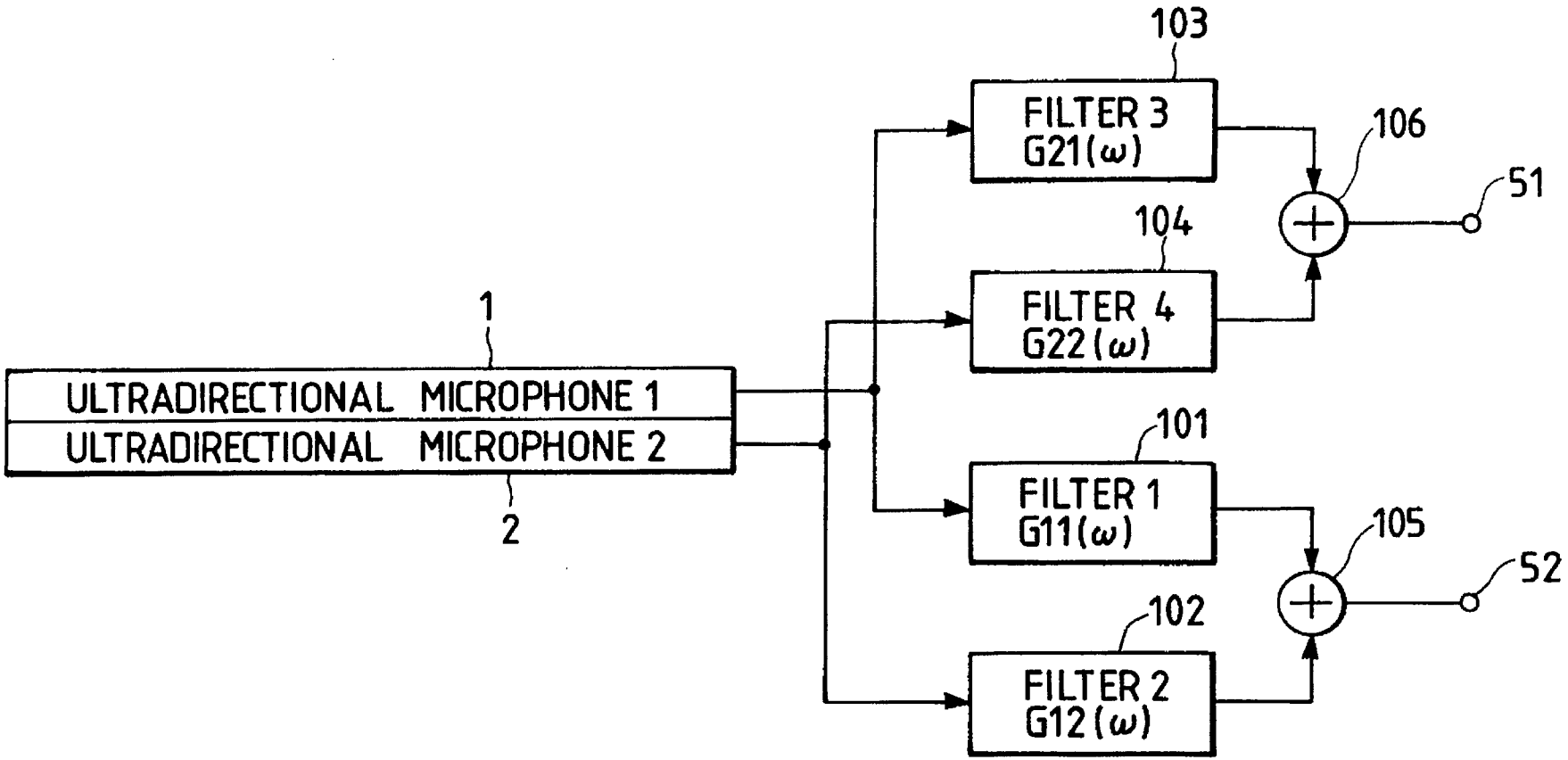
FIG. 7 is a bock diagram of a fourth embodiment of a stereo ultradirectional microphone apparatus.

Hereinbelow will be described a fourth embodiment of a stereo ultradirectional microphone of this invention with reference to drawings. FIG. 7 is a block diagram of the fourth embodiment for showing a structure of a stereo ultradirectional microphone apparatus of this invention. In FIG. 7, numeral 1 is a first ultradirectional microphone, and numeral 2 is a second ultradirectional microphone arranged on the left side of the first ultradirectional microphone 1 with a distance d in parallel to the first ultradirectional microphone 1 to have the same distance from a sound source existing in front thereof. Numeral 101 is a first filter having a transfer characteristic G11 (ω) for filtering the output of the first ultradirectional microphone 1. Numeral 102 is a second filter having a transfer characteristic G12(ω) for filtering the output of the second ultradirectional microphone 2. Numeral 103 is a third filter having a transfer characteristic G21(ω) for filtering the output of the first ultradirectional microphone 1. Numeral 104 is a fourth filter having a transfer characteristic G22(ω) for filtering the output of the second ultradirectional microphone 2. Numeral 105 is a first signal summing circuit for summing outputs of the first filter 101 and the second filter 102. Numeral 106 is a second signal summing circuit for summing outputs of the third filter 103 and the fourth filter 104. Numeral 51 is a first output terminal for supplying an output signal of the second signal summing circuit 106. Numeral 52 is a second output terminal for supplying an output signal of the first signal summing circuit 105.

Operation of the stereo ultradirectional microphone apparatus structured as mentioned above will be described with reference to FIGS. 7, 8, 9, and 10.

In FIG. 7, an output of the ultradirectional microphone 1 is supplied to a first filter 101 and the third filter 103. An output of the ultradirectional microphone 2 is supplied to a second filter 102 and the fourth filter 104. The first filter 101 filters the output of the ultradirectional microphone 1 with a transfer characteristic G11(ω). The second filter 102 filters the output of the ultradirectional microphone 2 with a transfer characteristic G12(ω). The third filter 103 filters the output of the ultradirectional microphone 1 with a transfer characteristic G21(ω). The fourth filter 104 filters the output of the ultradirectional microphone 2 with a transfer characteristic G22(ω). The first signal summing circuit 105 sums the outputs of the first and second filters 101 and 102 to supply a first stereo signal. The second signal summing circuit 106 sums the outputs of the third and fourth filters 103 and 104 to supply a second stereo signal.

Figure 8:
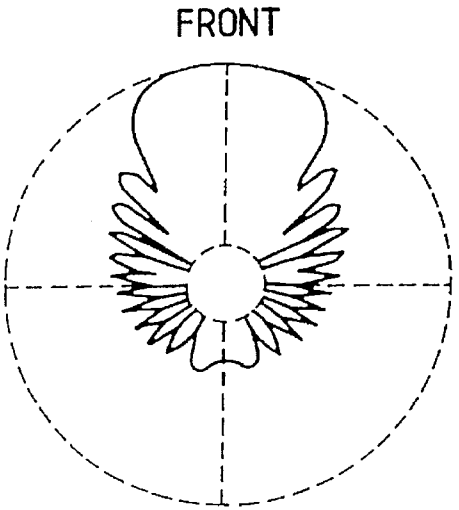
FIG. 8 is an illustration of the fourth embodiment for showing directivities of ultradirectional microphones.
Figure 9:
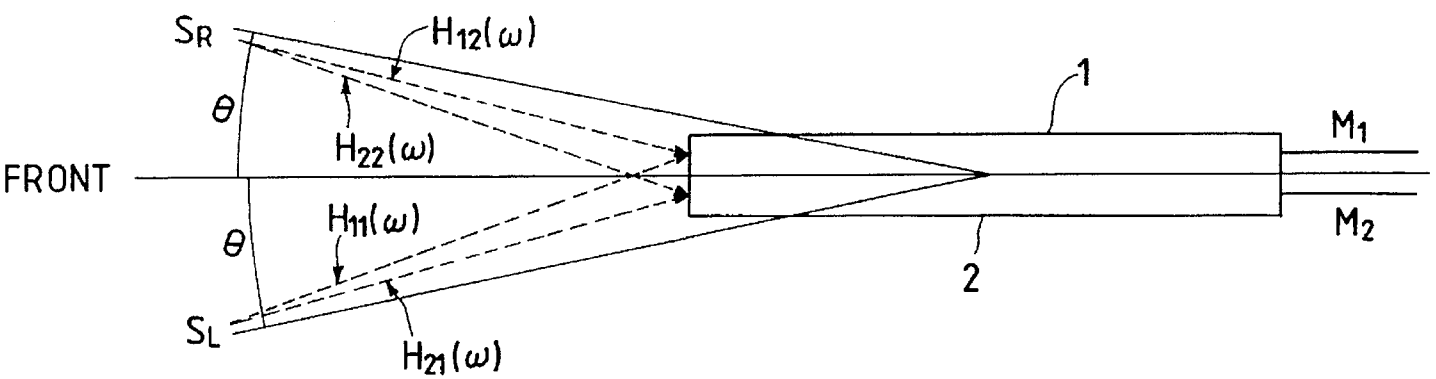
FIG. 9 is an illustration of the fourth embodiment for showing a positional relation between two sound sources and the main lobes of the first and second ultradirectional microphones.

FIG. 8 is an illustration of the fourth embodiment for showing directivities of ultradirectional microphones 1 and 2. In FIG. 7, it is assumed that the first ultradirectional microphone 1 has the substantially the same directional characteristic as the second ultradirectional microphone 2 as shown in FIG. 8. FIG. 9 is an illustration of the fourth embodiment for showing a positional relation between two sound sources $S_L$ and $S_R$ and the main lobes of the first and second ultradirectional microphones 1 and 2. In FIG. 9, assuming that the sound source located in the −θ direction (the direction providing clockwise angle θ) with respect to the main lobe is $S_R$, the sound source located in the +θ direction (the direction providing counterclockwise angle θ)with respect to the main lobe is $S_R$, a transer characteristic from the $S_L$ to the first ultradirectional microphone 1 is H11(ω), a transfer characteristic from the $S_R$ to the first ultradirectional microphone 1 is H12(ω),a transfer characteristic from the $S_L$ to the second ultradirectional microphone 1 is H21(ω), and a transfer characteristic from the $S_R$ to the second ultradirectional microphone 2 is H22(ω), the output M1 of the first ultradirectional microphone 1 against the sound sources $S_L$ and $S_R$ and the output M2 of the second ultradirectional microphone 2 against the sound sources $S_L$ and $S_R$ are given by:

$$\begin{pmatrix} M_1(\omega) \\ M_2(\omega) \end{pmatrix} = \begin{pmatrix} H_{11}(\omega) & H_{12}(\omega) \\ H_{21}(\omega) & H_{22}(\omega) \end{pmatrix} \begin{pmatrix} S_L(\omega) \\ S_R(\omega) \end{pmatrix} \tag{8}$$

Here, in order to obtain $S_L$ or $S_R$ from the outputs M1 and M2 of the first and second ultradirectional microphones 1 and 2, Eq. (8) is solved with respect to $S_L$ and $S_R$ by multiply Eq. (8) by the inverse matrix of the matrix H.

$$\begin{pmatrix} H_{11}(\omega) & H_{12}(\omega) \\ H_{21}(\omega) & H_{22}(\omega) \end{pmatrix}^{-1} \begin{pmatrix} M_1(\omega) \\ M_2(\omega) \end{pmatrix} = \begin{pmatrix} S_L(\omega) \\ S_R(\omega) \end{pmatrix} \tag{9}$$

$$\begin{pmatrix} G_{11}(\omega) & G_{12}(\omega) \\ G_{21}(\omega) & G_{22}(\omega) \end{pmatrix} \begin{pmatrix} M_1(\omega) \\ M_2(\omega) \end{pmatrix} = \begin{pmatrix} S_L(\omega) \\ S_R(\omega) \end{pmatrix}$$

Here, Eq. (9) indicates that $S_L$ and $S_R$ can be obtained by multiplying the outputs M1 and M2 of the first and second ultradirectional microphones 1 and 2 by the matrix G (which is an inverse matrix of the matrix H).

The structure shown in FIG. 7 effects this operation. The transfer characteristics G11(ω) to G22(ω) of the first to fourth filters shown in FIG. 7 are given by:

$$\begin{cases} G_{11}(\omega) = H_{22}(\omega)/(H_{11}(\omega)H_{22}(\omega) - H_{12}(\omega)H_{21}(\omega)) \\ G_{12}(\omega) = -H_{12}(\omega)/(H_{11}(\omega)H_{22}(\omega) - H_{12}(\omega)H_{21}(\omega)) \\ G_{21}(\omega) = -H_{21}(\omega)/(H_{11}(\omega)H_{22}(\omega) - H_{12}(\omega)H_{21}(\omega)) \\ G_{22}(\omega) = H_{11}(\omega)/(H_{11}(\omega)H_{22}(\omega) - H_{12}(\omega)H_{21}(\omega)) \end{cases} \tag{10}$$

Figure 10A:
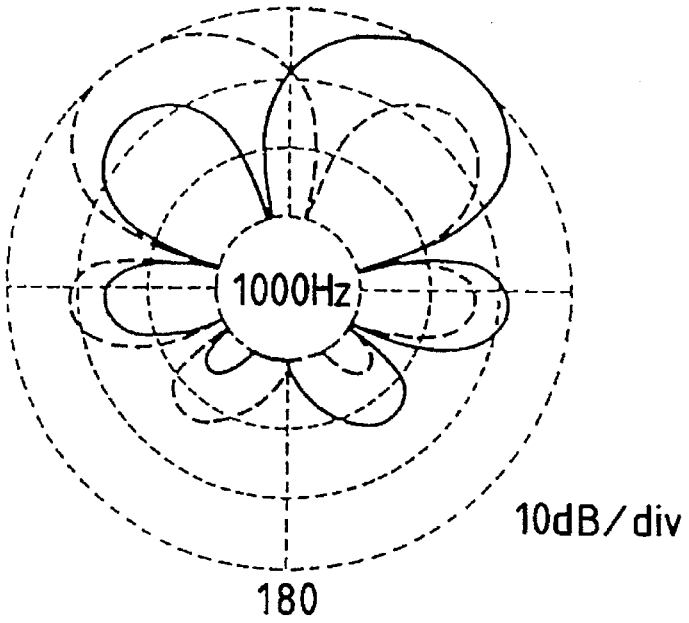
FIG. 10A shows a directivity of the fourth embodiment of the ultradirectional microphone apparatus at 1000 Hz.
Figure 10B:
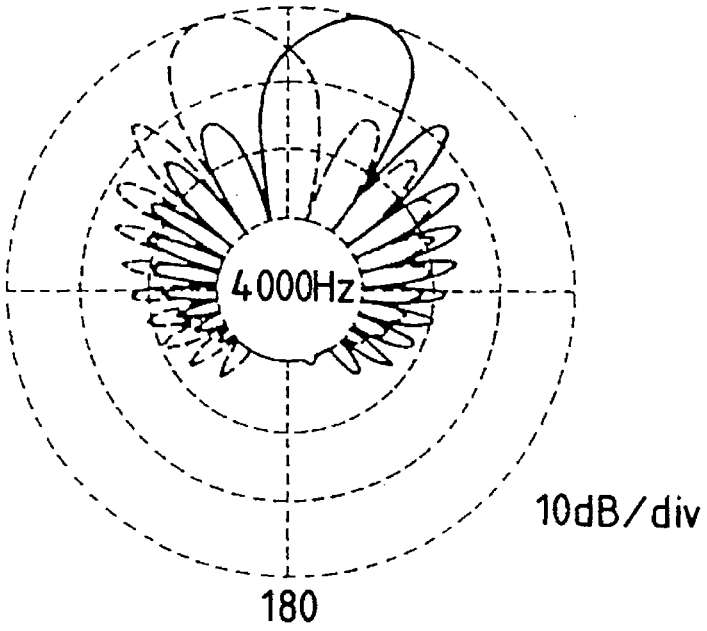
FIG. 10B shows a directivity of the fourth embodiment of the ultradirectional microphone apparatus at 4000 Hz.

As mentioned above, an output of the signal summing circuit 105 has a sensitivity in the direction of $S_L$ (+θ direction from the main lobe) by the structure shown in FIG. 7, by the transfer characteristics of the first and second filters 101 and 102, so that a dead angle is formed in the direction of $S_R$(−θ direction from the main lobe). On the other hand, an output of the signal summing circuit 106 has a sensitivity in the direction of $S_R$ (−θ direction from the main lobe) by the transfer characteristics of third and fourth filters 103 and 104, so that a dead angle is formed in the direction of $S_L$ (+θ direction from the main lobe). The value of θ is normally selected from 10° to 45°. The effect of the formation of the dead angle is to minimize the sensitivity of each stereo signal from each other. FIG. 10A shows a directivity of the fourth embodiment at 1000 Hz where the directivity in the output signal at the output terminal 51 is shown. FIG. 10B shows a directivity of the fourth embodiment at 4000 Hz where the directivity in the output signal at the output terminal 51 is shown. Solid lines shown in FIG. 10A represents a directional characteristic of Rch obtained from the first output terminal 51 at 1000 Hz. Solid lines shown in FIG. 10B represents a directional characteristic of Rch obtained from the first output terminal 51 at 4000 Hz. In this embodiment, the transfer characteristics H11(ω) to H22(ω) are obtained by measuring sound pressure frequency characteristics of the first and second ultradirectional microphones 1 and 2 in an anechoic chamber. In the measurement, the sound sources are arranged in the directions where dead angles are formed as shown in FIG. 9. In this embodiment, as similar to the second and third embodiments, the formation of dead angles is obtained accurately though there is a dispersion in the characteristics between the first and second ultradirectional microphones, so that a favorable stereo directional characteristic is provided. Further, in this embodiment, the first to fourth transfer characteristics are determined such that a first sensitivity in a first stereo signal in a first direction making a clockwise angle from a first axis, of a first unidirectional characteristic of a first microphone, is minimized and a second sensitivity in the second stereo signal is minimized in a second direction making a counterclockwise angle from a direction of a second axis in parallel with the first axis.

What is claimed is:

1. A stereo ultradirectional microphone apparatus for detecting a sound to produce first and second stereo sound signals, comprising:

(a) a first ultradirectional microphone, having a first unidirectional characteristic, for detecting and converting said sound into a first sound signal, said first unidirectional characteristic having a first axis;

(b) a second ultradirectional microphone, having a second unidirectional characteristic which is substantially the same as said first ultradirectional microphone, for detecting and converting said sound into a second sound signal, said second unidirectional characteristic having a second axis; said first and second ultradirectional microphones being arranged side by side with a predetermined distance therebetween such that said first axis is directed in the same direction D in parallel to said second axis substantially;

(c) a first filter, having a first transfer characteristic, for frequency equalizing said first sound signal;

(d) a second filter, having a second transfer characteristic, for frequency equalizing said second sound signal;

(e) first summing means for summing outputs of said first and second filters to supply said first stereo signal;

(f) a third filter, having a third transfer characteristic, for frequency equalizing said first sound signal;

(g) a fourth filter, having a fourth transfer function, for frequency equalizing said second sound signal; and (h) second summing means for summing outputs of said third and fourth filters to supply said second stereo signal, said first to fourth transfer characteristics being determined such that a first sensitivity in said first stereo signal in a first direction making a clockwise angle from said first axis is minimized and a second sensitivity in said second stereo signal in a second direction making a counterclockwise angle from said direction D is minimized.

2. A stereo ultradirectional microphone apparatus as claimed in claim 1, wherein it is assumed that said first to fourth transfer characteristics are G11(ω), G12(ω), G21(ω), and G22(ω) respectively and said first ultradirectional microphone has first and second sound pressure frequency characteristics in said first and second directions are H11(ω) and H12(ω) respectively, and said second ultradirectional microphone has third and fourth sound pressure frequency characteristics in said first and second directions are H21(ω) and H12(ω) respectively, said G11(ω) to G22(ω) and H11(ω) and H21(ω) are given by:

$$\begin{cases} G_{11}(\omega) = H_{22}(\omega)/(H_{11}(\omega)H_{22}(\omega) - H_{12}(\omega)H_{21}(\omega) \\ G_{12}(\omega) = -H_{12}(\omega)/(H_{11}(\omega)H_{22}(\omega) - H_{12}(\omega)H_{21}(\omega) \\ G_{21}(\omega) = -H_{21}(\omega)/(H_{11}(\omega)H_{22}(\omega) - H_{12}(\omega)H_{21}(\omega) \\ G_{22}(\omega) = H_{11}(\omega)/(H_{11}(\omega)H_{22}(\omega) - H_{12}(\omega)H_{21}(\omega). \end{cases}$$

3. A stereo ultradirectional microphone apparatus as claimed in claim 1, wherein said first ultradirectional microphone has a distance factor more than 2.0.

4. A stereo ultradirectional microphone apparatus as claimed in claim 1, wherein said first ultradirectional microphone has a directivity index less than 0.25.

5. A stereo ultradirectional microphone apparatus as claimed in claim 1, wherein said first ultradirectional microphone has a distance Factor more than 2.2.

6. A stereo ultradirectional microphone apparatus as claimed in claim 1, wherein said first ultradirectional microphone has a directivity index less than 0.20.

* * * * *